United States Patent [19]

de Ronde

[11] Patent Number: 4,956,622

[45] Date of Patent: Sep. 11, 1990

[54] WAVEGUIDE H-PLANE JUNCTIONS

[75] Inventor: Frans C. de Ronde, Bath, United Kingdom

[73] Assignee: National Research Development Corporation, London, England

[21] Appl. No.: 276,844

[22] Filed: Nov. 28, 1988

Related U.S. Application Data

[63] Continuation-in-part of Ser. No. 55,131, May 28, 1987, Pat. No. 4,891,614.

[30] Foreign Application Priority Data

| | | | |
|---|---|---|---|
| May 29, 1986 | [GB] | United Kingdom | 8613028 |
| Apr. 8, 1987 | [GB] | United Kingdom | 8708373 |
| Nov. 30, 1987 | [GB] | United Kingdom | 8728017 |

[51] Int. Cl.[5] ..... H01P 5/12

[52] U.S. Cl. ..... 333/125; 333/137

[58] Field of Search ..... 333/121-123, 333/125, 137

[56] References Cited

U.S. PATENT DOCUMENTS

| | | | |
|---|---|---|---|
| 2,584,162 | 2/1952 | Sensiper et al. | 333/122 |
| 2,892,982 | 6/1959 | Allen | 333/117 |
| 2,976,500 | 3/1961 | Brockwell et al. | 333/122 |
| 3,311,851 | 3/1967 | Abrams | 333/122 |
| 3,375,472 | 3/1968 | Walker | 333/122 |
| 4,174,507 | 11/1979 | Young | 333/122 |
| 4,217,565 | 8/1980 | Salzberg | 333/258 |
| 4,413,242 | 11/1983 | Reeves et al. | 333/122 |
| 4,642,586 | 2/1987 | Fowler | 333/122 |

FOREIGN PATENT DOCUMENTS 665434 1/1952 United Kingdom .

OTHER PUBLICATIONS

G-MTT Microwave Symposium-Digest, Palo Alto, May 16-19, 1966, p. 208; IEEE, New York, U.S.; F. C. DeRonde: "Full-Band Matching of Waveguide Discontinuities"; p. 208, lines 3-8, 15-19, 24-29.

15th European Microwave Conference Proceedings, Paris, Sep. 9-13, 1985, pp. 329-334; Microwave Exhibitions and Publ. Ltd, Kent, GB, F. C. De Ronde: "Miniaturisation in E-Plane Technology", p. 329, line 26-p. 330, line 4; FIG. 1.

1986 IEEE-MTT-S International Microwave Symposium-Digest, Baltimore, Jun. 2-4, 1986, pp. 151-154; IEEE, New York, U.S.; F. C. De Ronde: "An Octave--Wide Matched Impedance Step and -Quarterwave Transformer" (complete article).

*Primary Examiner*—Eugene R. LaRoche
*Assistant Examiner*—Benny Lee
*Attorney, Agent, or Firm*—Cushman, Darby & Cushman

[57] ABSTRACT

An H-plane waveguide 'T' junction is described in which matching is achieved over a full waveguide band at the waveguide which forms the stem of the 'T'. Reflection from the wall facing the stem is reduced by using a probe as a monopole located about a quarter of a wavelength from the said wall. Variations with frequency in the reflection coefficient at the stem are reduced by a disc, at the foot of the probe, which acts as a radial reduced quarter wave transformer.

11 Claims, 2 Drawing Sheets

WAVEGUIDE H-PLANE JUNCTIONS

This application is a continuation-in-part of my copending application Ser. No. 07/055,131 filed May 28, 1987, now U.S. Pat. No. 4,891,614 issued Jan. 2, 1990.

The present invention relates to methods and apparatus for matching three port H-plane junctions over a full waveguide band.

H-plane junctions have been known for several decades but have not been as widely used as might be expected in view of the fairly high reflections which occur. For H-Tees these reflections are particularly high in that part of the Tee which forms the stem of the T.

According to a first aspect of the present invention there is provided an H-plane junction comprising first, second and third rectangular waveguide portions joined together with the first and second portions end to end but not necessarily aligned and the third portion opening into the junction of the first and second portions along one narrow side of the junction, first matching means for reducing the reflection of waves travelling into the junction from the third portion, and second matching means for reducing the variation with frequency of the reflection coefficient in the third waveguide for waves reflected from the junction including the first matching means.

H-plane junctions according to the invention include Y junctions or H-Tees. Each such junction is preferably substantially symmetrical about a plane through the third portion parallel to the narrow sides thereof and the first matching means preferably comprises an elongated conductor positioned in the said plane at a distance, from that wall of the junction which is opposite the third portion, which is less than half the broad dimension of the first and second waveguide portions. The elongated conductor acts as a short-circuited monopole and is located about a quarter of a wavelength away from the said wall so that currents induced in the conductor radiate in antiphase with reflections from that wall of the Tee which is opposite the third portion, cancelling reflections into the third portion. The elongated conductor radiates into the first and second portions in phase with the direct coupling from the third portion into the first and second portions.

As is described in more detail later, the second matching means may for example comprise a disc at one end of the elongated conductor or a capacitive probe positioned a quarter of a guide wavelength from the elongated conductor on that side thereof which is adjacent to the third portion.

The invention also includes a method of matching an H-plane junction equivalent to the first aspect of the invention.

Without matching, an H-plane Tee has a reflection coefficient at the third waveguide which, over a complete waveguide band, reaches 80%. With the invention this coefficient can be reduced to about 5% over a full waveguide band.

Figure 1:
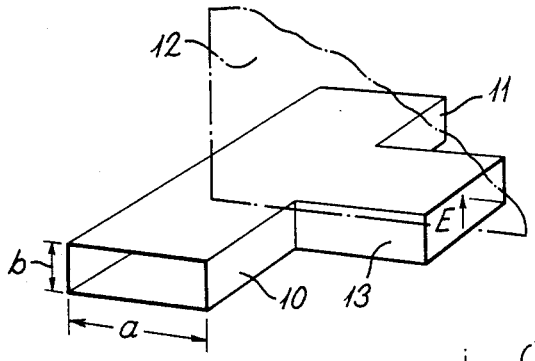
Fig. 1 (Prior Art)
Figure 2A:
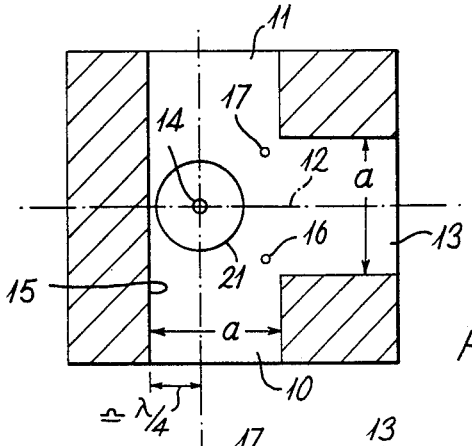
Figure 2B:
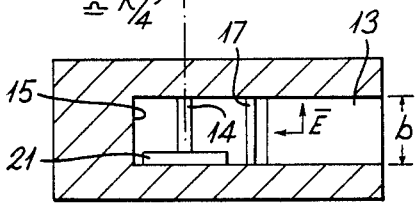
Figure 3:
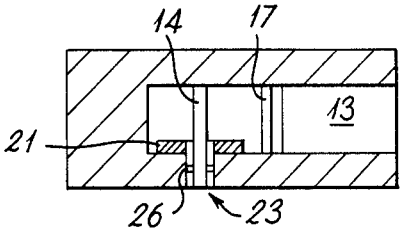
Figure 4:
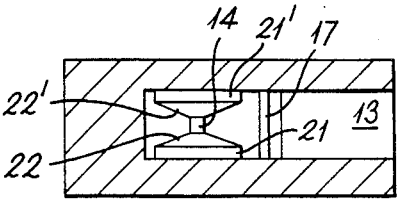
Figure 5:
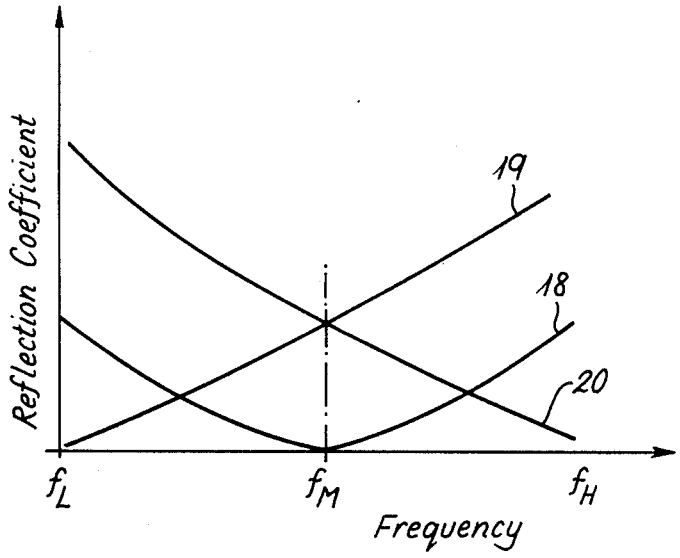
Figure 6:
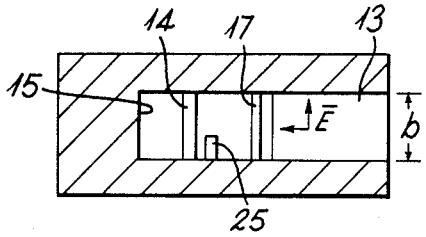

Certain embodiments of the invention will now be described by way of example with reference to the accompanying drawings, in which:

FIG. 1 is a perspective view of an H-Tee,

FIGS. 2*a* and 2*b* are cross-sectional plan and side views, respectively, taken along planes of symmetry of an H-Tee according to the invention, FIG. 3 shows a cross-sectional side view taken along a plane of symmetry of a Tee, including a coaxial line, used in explaining full band matching, FIG. 4 is a cross-sectional side view taken along a plane of symmetry of a further embodiment of the invention, FIG. 5 shows variation with frequency of the reflection coefficient of the main port of the Tee of FIGS. 2*a* and 2*b* for various positions of a probe, but without a disc matching element, and FIG. 6 is a cross-sectional side view, taken along a vertical plane of symmetry, of an alternative to FIG. 2*b*.

The H-Tee of FIG. 1 comprises first and second waveguide portions 10 and 11 joined end to end at a plane of symmetry 12 and a third waveguide portion 13 opening into the other portions at right angles thereto along one narrow side of the other portions. The letters "a" and "b" refer to the broad and narrow dimensions of the waveguides and "E" indicates the direction of electric field. The exterior of FIG. 1, of course, is conventional, but notwithstanding the "prior art" legend or considered with FIGS. 2–6 it is not conventional since the matching means of the present invention are internal.

Waves travelling towards the Tee along the waveguide portion 13 are partially reflected back along this portion in two ways: firstly due to the wall 15 which is opposite the waveguide portion 13, and secondly due to the change in width of the waveguide portion 13 where it meets the portions 10 and 11.

In the arrangements shown in FIGS. 2*a* and 2*b*, reflection due to the second of these causes can be reduced by inserting inductive posts 16 and 17 near the corners of the portion 13 with the portions 10 and 11. Since currents flow vertically in the narrow walls of the waveguide portions, the posts 16 and 17 can be seen as providing a path for some of these currents in the region of the junction and thus provide a more gradual transition to the portions 10 and 11 which form a waveguide of infinite width for waves from the portion 13.

Reflection from the end wall 15 is reduced by using a probe 14 (see FIGS. 2*a* and 2*b*) as a monopole located about a quarter of a wavelength away from the wall 15. Incoming radiation from the portion 13 can be said to induce currents in the probe 14 which radiate a signal which is out of phase with reflections from the end wall 15 as far as the waveguide portion 13 is concerned. Thus reflection from the end wall is cancelled but the monopole radiates in phase with the direct coupling from the waveguide portion 13 into the portions 10 and 11.

The reflection coefficient as seen from the portion 13 with the probe 14 in place varies with frequency according to the position of the probe. FIG. 5 shows this variation for three probe positions. If the frequency band of operation of the Tee varies from a low frequency ($f_L$) to a high frequency ($f_H$) then a curve 18 shows the reflection coefficient variation when the post 14 is a distance a quarter of a guide wavelength at a frequency ($f_M$) near the centre of the band from the wall 15. Such a characteristic is difficult to match over a wide band because it first decreases and then increases. The curve 19 shows the variation of reflection coefficient when the distance of the post 14 from the end wall 15 is a quarter of a guide wavelength at the frequency $f_L$ or below and the curve 20 shows the variation when the distance is a quarter of a guide wavelength at $f_H$ or above. Both the characteristics 19 and 20 are easier to match but it is preferred to match the characteristic 19 which is equivalent to an increase in capacitance seen from the portion 13. A way to cancel this increase in capacitance and provide full band matching is to insert a fairly thin capacitive probe 25 (see FIG. 6) on the plane of symmetry 12 no more than an eighth of a guide wavelength at the frequency $f_H$ from the probe 14 in the direction of the portion 13. A capacitive probe, such as the probe 25, has the same reflection characteristic as the curve 19 and in the position proposed it is of opposite sign.

A preferred method of providing full band matching by overcoming the reflection variations with frequency mentioned above is to regard the probe as the centre conductor of a coaxial line, and match the coaxial line with the probe to the waveguide portion 13 as though the waveguide portions 10 and 11 were not present (these two portions do not have much effect on reflection into the portion since the main cause is the wall 15). When properly matched there is no net reflection from the end wall and the probe towards the waveguide portion 13. Such an arrangement is shown in FIG. 3 with a coaxial line 23 terminated by a conductive plunger 26 (shown schematically). Matching is as described in connection with FIG. 13*a* of British Patent Application No. 8712030, and corresponding U.S. application Ser. No. 55131 and European Application No. 87304521.5, except that the reduced quarter wave transformer (that is a transmission line having a length equal to a quarter of a wavelength at a frequency above the working band) inside the coaxial line is omitted and only the outer such transformer is present in the form of a disc 21. Thus the disc 21 forms a radial reduced quarter wave transformer having a transmission line length equal to the radius of the disc 21. Thus the radius of the disc is equal to a quarter of a wavelength (in the junction) at a frequency a little above the frequency $f_H$.

By using the disc to, in effect, short-circuit the coaxial line, with the resulting arrangement as shown in FIGS. 2*a* and 2*b* where the coaxial line has disappeared, all energy from the now, non-existent coaxial line passes instead into the portions 10 and 11, and as part of the cancelling wave for the portion 13.

For maximum effect the probe 14 should be about a quarter of the guide wavelength at the centre frequency of the band but that length would leave a small gap between its upper end and the upper wall of the Tee. In order to prevent sparking at high powers and to give a stronger construction, especially for millimeter waves, the probe is joined to the upper wall as shown.

A construction which is easier to manufacture, especially for millimeter waves, is shown in FIG. 4 where a conical taper 22 joins the disc 21 to the probe 14. The taper does not have much effect on operation as long as its dimensions are short compared with the guide wavelength in its vicinity. The taper 22 may instead be a series of steps.

The disc 21 and the taper 22 are duplicated as shown in FIG. 4 by a further disc 21' and taper 22' in order to strengthen the components. In addition it is advantageous to reduce the length of the probe 14 to avoid unwanted resonances. It can be seen that such an arrangement will function since if the arrangement of FIG. 4 is divided in half about a horizontal conducting plane of symmetry then the components below the plane of symmetry are the same as those of FIG. 2*b* (except for the taper 22) and will therefore function in a similar way. Since the components below the plane of symmetry can be reproduced above this plane and will function in the same way on both sides of the plane, the junction of FIG. 4 can be seen to be derived from that of FIG. 2*b*. However, as derived in this way, the junction would be twice as high as in FIG. 2*b*, so some empirical adjustment of the dimensions of the post 14, the discs 21 and 21' and the tapers 22 and 22' is necessary.

Although the invention has been specifically described with reference to H-Tees it also includes Y-plane junctions which use the same type of matching to give full band matching at one port.

The invention can also be put into practice in other ways by using matching elements of different types to cancel the reflections of waves from the portion 13 and to ensure that the cancellation functions over a full waveguide band. For example that part of the disc 21 which is between the probe 14 and the wall 15 may, it is believed, be reduced in size or even omitted.

Further, the inductive posts 16 and 17 can be omitted although full band matching is more difficult, and the position of the probe 14 and the dimensions of the disc 21 are different and more critical.

I claim:

1. An H-plane junction comprising:

first, second and third rectangular waveguide portions, each waveguide portion formed by a pair of opposite wide walls and a pair of opposite narrow walls, the waveguide portions being joined together at a junction with the first and second portions arranged end to end and the third portion opening into the junction on one side thereof along adjacent narrow walls of the first and second portions, the junction being substantially symmetrical about a plane through the third portion parallel to the narrow walls thereof, first matching means, disposed inside said junction, for reducing the reflection of waves travelling into the junction from the third portion, and second matching means inside the junction for reducing the variation with frequency of the reflection coefficient in the third waveguide for waves reflected from the junction including reflections from the first matching means, said first matching means comprising an elongated conductor positioned in the said plane at a distance, from that narrow wall of the junction which is opposite the third portion, which is less than half the dimension of the wide wall of each first land second portion, the said elongated conductor being joined to two opposite wide walls of the junction.

2. An H-plane junction according to claim 1 wherein the first matching means includes two conductors which are parallel to the narrow walls of the said portions and contact the wide walls thereof, the said two conductors being positioned adjacent to first and second corners formed where the third portion joins the first and second portions, respectively.

3. An H-plane junction according to claim 1 wherein the said distance is a quarter of a guide wavelength at a frequency at least as high as the highest frequency of a predetermined working frequency band of the junction.

4. An H-plane junction according to claim 1 wherein the said distance is a quarter of a guide wavelength at a frequency at least as low as the lowest frequency of a predetermined working frequency band of the junction.

5. An H-plane junction according to claim 4 wherein the second matching means comprises a capacitive probe positioned no more than an eighth of the guide wavelength at a frequency at least as high as the said highest frequency from the elongated conductor on that side thereof which is adjacent to the third portion.

6. An H-plane junction according to claim 1 wherein the second matching means comprises a generally disc shaped conductive member coaxial with the elongated conductor and in contact with one wall of the junction.

7. An H-plane junction according to claim 6 wherein the transition from the disc to the elongated conductor is stepped.

8. An H-plane junction according to claim 7 including a further disc and a further stepped transition which join the elongated conductor to a wall of the Tee opposite the said one wall.

9. An H-plane junction according to claim 6 wherein the transition from the disc to the elongated conductor is tapered.

10. An H-plane junction according to claim 9 including a further disc and a further tapered transition which join the elongated conductor to a wall of the Tee opposite the said one wall.

11. An H-plane junction according to claim 6 including a further disc which joins the elongated conductor to a wall of the Tee opposite the said one wall.

* * * * *